United States Patent [19]

Fujimoto

[11] Patent Number: 4,624,387

[45] Date of Patent: Nov. 25, 1986

[54] EASY-TO-OPEN LID OF A CONTAINER

[75] Inventor: Hiroshi Fujimoto, Tokyo, Japan

[73] Assignee: Toyo Seikan Kaisha Limited, Tokyo, Japan

[21] Appl. No.: 716,640

[22] Filed: Mar. 27, 1985

[30] Foreign Application Priority Data

Mar. 29, 1984 [JP] Japan ..... 59-44125[U]

[51] Int. Cl.[4] ..... B65D 17/34; B65D 17/35; B65D 17/36

[52] U.S. Cl. ..... 220/273

[58] Field of Search ..... 220/269–273

[56] References Cited

U.S. PATENT DOCUMENTS 3,478,917 11/1969 Rouse et al. ..... 220/273

*Primary Examiner*—George T. Hall

*Attorney, Agent, or Firm*—Kenyon & Kenyon

[57] ABSTRACT

An easy-to-open lid for a liquid container containing, for example, a refreshing beverage has a lid panel provided with a score line defining a severable area. The lid panel has a rivet integral therewith and anchoring a pull-tab adapted to be pulled by a finger. The lid further has at least one stiffening dimple formed in the severable area of the lid panel such as to resist the bending force applied to a region around the rivet. The dimple is formed as a rib convexed inwardly or outwardly of the container from the plane of the lid panel and extending across the boundary line between the region near the rivet and the other portion of the lid panel.

8 Claims, 10 Drawing Figures

EASY-TO-OPEN LID OF A CONTAINER

BACKGROUND OF THE INVENTION

The present invention relates to the construction of a lid for a liquid container containing, for example, a refreshing beverage and, more particularly, to an improvement in the construction of an easy-to-open lid of the type having a pull-tab which is adapted to be pulled up by a user's finger to facilitate the tearing of the lid along a score line thus opening the container.

Liquid containers such as cans containing refreshing beverages are widely used in which a lid secured to the top end of the container barrel is provided with a finger-retaining tab adapted to be pulled by a finger whereby the lid is torn along a score line. For reasons which will be explained later with reference to the drawings, users have encountered a problem in that the severable area of the lid panel is often cracked or the pull-tab may be torn off when the tab is pulled by the user's finger.

SUMMARY OF THE INVENTION

Accordingly, it is a primary object of the invention to provide an easy-to-open lid of a container which can eliminate the problem of cracking in the lid panel or tearing off of the pull-tab, thereby overcoming the problems of the prior art.

To this end, according to the invention, there is provided an easy-to-open lid for a container containing a liquid such as a refreshing beverage having a lid panel provided with a score line defining a severable area, the lid panel having a rivet integral therewith and anchoring a pull-tab adapted to be pulled by a finger, at least one stiffening dimple being formed in the portion of the severable area in the vicinity of the rivet such as to resist the bending force applied to this portion of the lid panel, thereby preventing cracking of this portion and tearing off of the tab.

The above and other objects, features and advantages of the invention will become clear from the following description of the preferred embodiment when the same is read in conjunction with the accompanying drawings.

DESCRIPTION OF THE PREFERRED EMBODIMENT

Figure 9:
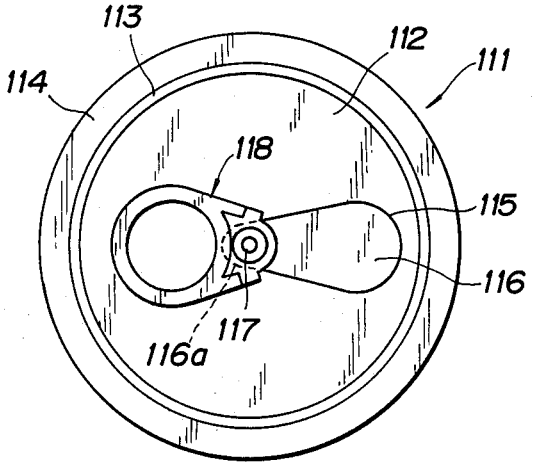
FIG. 9 is a plan view of a conventional easy-to-open lid.
Figure 10:
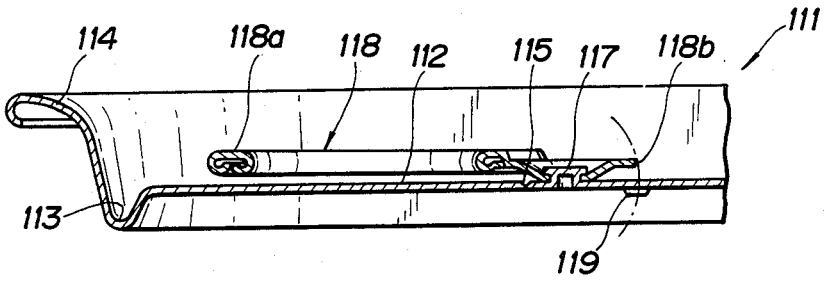
FIG. 10 is a sectional view of an essential part of the conventional lid.

Before starting the description of the embodiment, an explanation will be made hereinunder as to a conventional easy-to-open lid with specific reference to FIGS. 9 and 10, in order to make understood the problems encountered by the prior art and hence the advantages brought about by the present invention.

As will be seen from these Figures, a typical conventional easy-to-open container lid generally designated by a numeral 111 has a panel 112 in which is formed a substantially sector-shaped score line 115 which defines a sector-shaped severable area 116.

A rivet 117 is formed by a deep drawing or spinning in the portion of the panel 112 coinciding with the center of curvature of the radially inner arcuate line 116*a* of the severable area 116. A pull-tab 118 is secured at its one end to the rivet 117.

When opening the container, the user pulls the free end of the tab 118 upwardly. In consequence, an upward force is applied to the rivet 117 so that the tearing is initiated along the above-mentioned arcuate line 116*a*. As the tab 118 is further pulled upward, the panel 112 is torn along the score line 115 so that the severable area 116 can be removed completely, thus opening the container easily.

In this conventional structure, however, a problem has been encountered in which the portion of the severable area 116 near the end of the tab 118 is undesirably torn off when the tab 118 is pulled up to open the lid. Two manners of tearing off are conceiveable: namely, tearing off along the line M of contact by the end of the tab and tearing off within the region B near the rivet. In order to prevent the first manner of tearing, i.e., the tearing off of the separable area along the line M contacted by the tab end, there have been proposed various counter measures such as the provision of a stiffening rib 119 on the line M of contact by the tab end. Unfortunately, however, no effective measure has been proposed nor developed for preventing the tearing off of the separable area 116 in the region B near the rivet.

Thus, the known structure still suffers from the problem of tearing off of the separable area 116 in the region L near the rivet due to bending force applied thereto when the tab is pulled upwardly.

This problem, however, can be overcome by the present invention as will be understood from the following description of the embodiment.

Referring to FIGS. 1 to 4 which in combination show an embodiment of an easy-to-open lid of the invention, the lid generally designated by a numeral 1 has a thin disc-shaped panel 2 which is provided in the peripheral portion thereof with an annular groove 3 which is surrounded by an upright peripheral flange 4. The panel 2 has a substantially sector-shaped score line 5 formed therein and defining a sector-shaped severable area 6. The center of the curvature of the inner arcuate line 6*a* defining a part of the sector-shaped severable area 6 coincides with the center of the lid 1. As will be seen from FIGS. 3 and 5, the score line 5 microscopically has the form of a V-shaped groove so that the thickness of the panel immediately below the score line 5 is considerably smaller than the thickness of the other portions of the panel 2. It is, therefore, possible to easily open the container by tearing the panel 2 along the score line 5. A rivet 7 is formed integrally with the panel 2 by deep drawing or spinning of the material of the panel 2. The rivet 7 is located at the center of the curvature of the above-mentioned arcuate line 6*a* constituting a part of the sector score line 5, within the sector-shaped severable area 6. A pull-tab 8 is secured at its end to the rivet 7.

Since the rivet 7 is formed by effecting deep drawing or spinning on the material of the panel 2, compressive or tensile force is applied to the portion B of the panel 2 near the rivet 7 so that the portion B becomes fragile undesirably.

Figure 3:
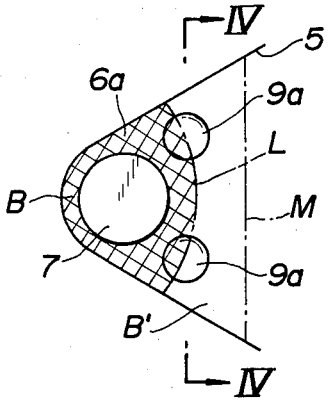
FIG. 3 is a view taken along the line III—III of FIG. 2 showing in particular a pair of dimples formed in the lid.
Figure 4:
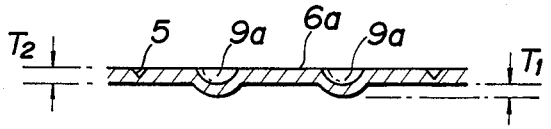
FIG. 4 is a sectional view taken along the line IV—IV of FIG. 3.

In order to compensate for the reduction in the mechanical strength of the portion B, according to the invention, a suitable number of dimples 9 are formed in the fragile portion B of the panel 2 such as to increase the surface rigidity of this portion B of the panel 2, as shown in FIGS. 3 and 4.

Figure 1:
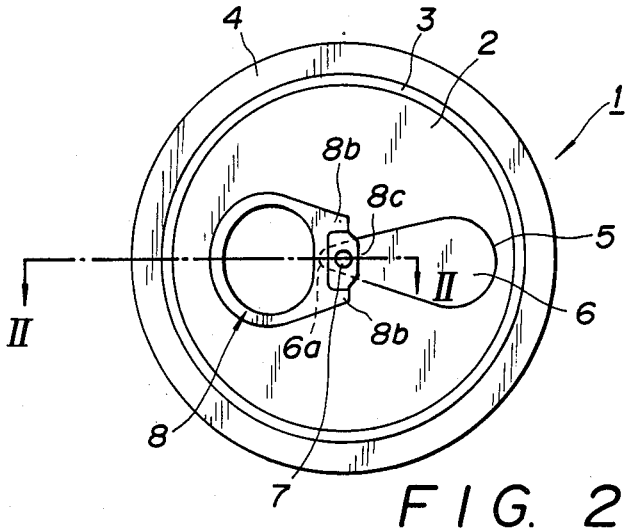
FIG. 1 is a plan view of a first embodiment of an easy-to-open lid in accordance with the invention.
Figure 2:
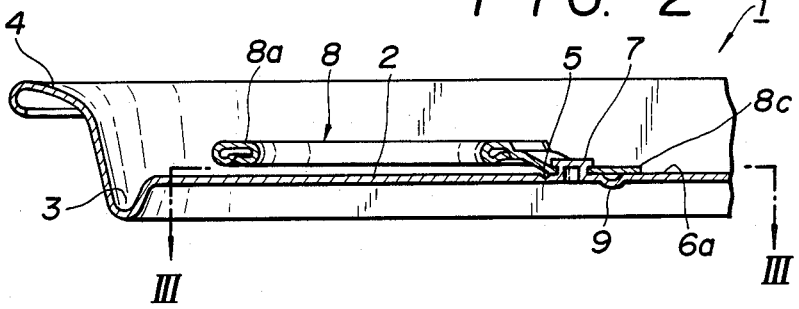
FIG. 2 is a sectional view of an essential part of the lid taken along the line II—II of FIG. 1.

More specifically, in the embodiment shown in FIG. 2, each of the dimples 9 is constituted by a circular recess 9*a* projected inwardly of the container and is located, as shown in FIG. 3, on a line along which the bending is most likely to occur during the can opening action, i.e., the boundary line L between the fragile portion B and the portion B′ which has not been fragile. Each dimple 9 has a substantial length or width in the direction of tearing, i.e., across the above-mentioned line L. In the embodiment shown in FIG. 2, two dimples 9 in the form of circular ribs 9*a* are formed to project inwardly of the container from the plane of the panel 2 as shown in FIG. 3. The shape and the number of the dimples, however, are subject to change as required. For instance, in a modification shown in FIG. 5, the panel 2 has two dimples 9 in the form of substantially elliptical ribs 9*b* protruded outwardly from the plane of the panel 2 and having a substantial length across the line L.

Figure 5:
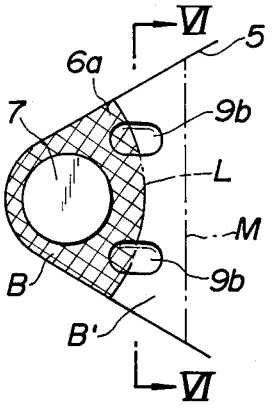
FIG. 5 is an illustration of another example of the dimples.
Figure 6:
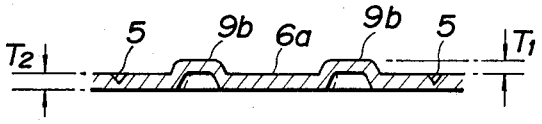
FIG. 6 is a sectional view taken along the line VI—VI of FIG. 5.

Thus, in the example shown in FIGS. 3 and 4, the dimples 9 are constituted by circular ribs 9*a* concaved inwardly from the panel 2, while, in the example shown in FIGS. 5 and 6, the dimples 9 are constituted by elliptical ribs 9*b* convexed outwardly from the panel 2. In each case, the ribs have a thickness $T_1$ equal to the thickness $T_2$ of other portions of the panel 2.

Figure 7:
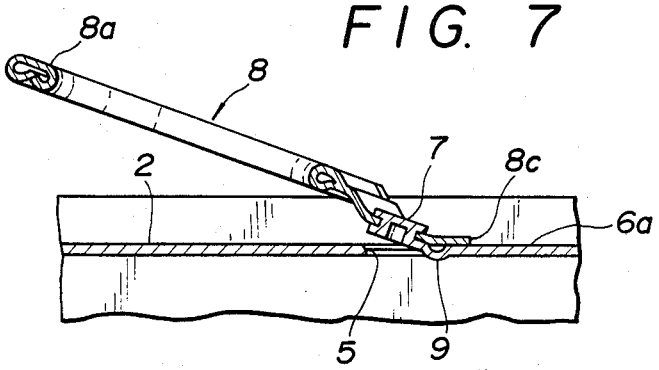
FIGS. 7 and 8 are sectional views of the lid illustrating how the lid is torn.

For opening the container, the user pulls the free end 8*a* of the tab 8 upwardly such as to cause a lever action around fulcrums constituted by the outer ends 8*b*,8*b* of the tab 8 contacting the portion of the panel surface outside the severable area 6. In consequence, an upward pulling force is applied to the portion of the panel 2 near the rivet 7 such as to initiate the tearing along the portion of the score line 5, i.e., the radially inner arcuate line 6*a* defining the severable area 6 (see FIG. 7). In consequence, the panel is partially opened within the severable area 6 so that the area 6 becomes a partly severed portion. Then, as the tab 8 is pulled up further, the central end 8*c* of the tab 8 comes into contact with the partly severed portion 6 to bend the latter substantially at a right angle along the line M (see one-dot-and-dash line in FIG. 8) contacted by the end of the tab. A further application of the pulling force causes a bending action on the portion of the partly severed portion 6 near the rivet, i.e., on the portion B which has been made fragile.

Figure 8:
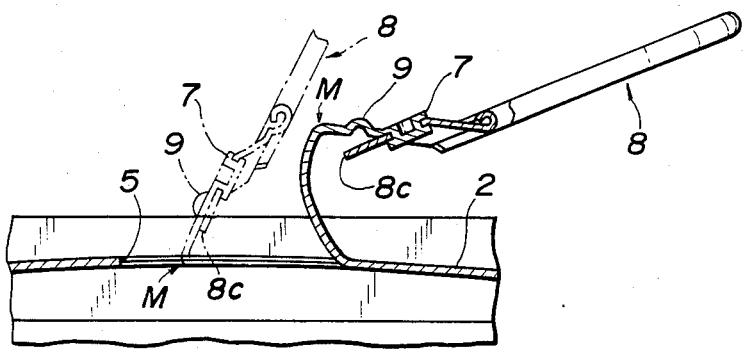

In the easy-to-open container lid of the invention, however, the dimples 9, provided across the boundary line L between the fragile portion B and the remainder portion, resist this bending force so that the bending of the fragile portion B is limited and the cracking or tearing off of the fragile portion B is avoided (see full line in FIG. 8). As the tab 8 is lifted further, the severable area 6 is completely severed from the panel 2 along the score line 5, thus allowing an easy opening of the container.

As has been described, the easy-to-open container lid of the invention has dimples formed in the portion of the lid panel which has been made fragile, such as to resist the bending force which tends to be concentrated on this portion of the lid panel.

Consequently, the bending of the fragile portion is limited and the tearing off of the severable area of the panel during the opening operation is avoided to ensure a smooth and safe opening of the container lid along the score line.

Although the invention has been described through specific terms, it is to be noted here that the described embodiments are not exclusive and various changes and modifications may be imparted thereto without departing from the scope of the invention which is limited solely by the appended claims.

What is claimed is:

1. In an easy-to-open container lid comprising a lid panel provided with a score line defining a severable area, said severable area having a rivet integral therewith, a pull tab anchored by said rivet to said severable area, wherein said pull tab has a first end adapted to be pulled by a finger and a second opposite contact end for contacting said severable area when said pull tab is pulled, with said second opposite contact end defining a line of contact on said severable area when said pull tab is pulled, the improvement comprising:

stiffening means formed in said severable area and located solely between said rivet and said line of contact defined by said second opposite contact end, said stiffening means being located apart from said line of contact defined by said second opposite contact end.

2. In an easy-to-open container lid comprising a lid panel provided with a score line defining a severable area, said severable area having a rivet integral therewith, a pull tab anchored by said rivet to said severable area, wherein said pull tab has a first end adapted to be pulled by a finger and a second opposite contact end for contacting said severable area when said pull tab is pulled, with said second opposite contact end defining a line of contact on said severable area when said pull tab is pulled, and wherein said severable area includes a fragile region immediately adjacent said rivet and inside said line of contact with said fragile region being more fragile than the remaining portion of said severable area with said fragile region and said remaining portion defining a boundary therebetween, the improvement comprising:

stiffening means formed in said severable area at a location between said rivet and said line of contact defined by said second opposite contact end and disposed across the boundary between said fragile region and said remaining portion of said severable area, said stiffening means being located apart from said line of contact defined by said second opposite contact end.

3. An easy-to-open container lid according to claim 1 wherein said stiffening means comprises at least one stiffening dimple.

4. An easy-to-open container lid according to claim 3 whrein said dimple comprises a rib convex inwardly with respect to the plane of said lid panel.

5. An easy-to-open container lid according to claim 3 wherein said dimple comprises a rib convex outwardly with respect to the plane of said lid panel.

6. An easy-to-open container lid according to claim 2 wherein aid stiffening means comprises at least one stiffenig dimple.

7. An easy-to-open container lid according to claim 6 wherein said dimple comprises a rib convex inwardly with respect to the plane of said lid panel.

8. An easy-to-open container lid according to claim 6 wherein said dimple comprises a rib convex outwardly with respect to the plane of said lid panel.

* * * * *